US006626640B2

(12) United States Patent
Ivanovic

(10) Patent No.: US 6,626,640 B2
(45) Date of Patent: Sep. 30, 2003

(54) FAN WITH REDUCED NOISE

(75) Inventor: Borislav Ivanovic, Santa Clara, CA (US)

(73) Assignee: Durmitor Inc., Santa Clara, CA (US)

( * ) Notice: Subject to any disclaimer, the term of this patent is extended or adjusted under 35 U.S.C. 154(b) by 0 days.

(21) Appl. No.: 10/042,977

(22) Filed: Nov. 19, 2001

(65) Prior Publication Data

US 2003/0095864 A1 May 22, 2003

(51) Int. Cl.[7] ..... F04D 29/38

(52) U.S. Cl. ..... 415/142; 415/208.2; 415/211.2; 416/189; 416/191; 416/244 R

(58) Field of Search ..... 415/142, 191, 415/208.2, 211.2, 173.1, 173.6; 416/189, 191, 243, 244 R

(56) References Cited

U.S. PATENT DOCUMENTS 2,426,742 A * 9/1947 Pawlowski ..... 416/189
4,093,402 A * 6/1978 Van Holten ..... 416/236 A
4,358,245 A 11/1982 Gray ..... 416/189
5,445,215 A * 8/1995 Herbert ..... 165/80.3
5,564,901 A * 10/1996 Moore ..... 416/91
5,616,974 A 4/1997 Yamada ..... 310/68
6,352,408 B1 * 3/2002 Kilian ..... 416/191

* cited by examiner

*Primary Examiner*—Ninh H. Nguyen
(74) *Attorney, Agent, or Firm*—Alan H. MacPherson; MacPherson Kwok Chen & Heid LLP

(57) ABSTRACT

A rotating blade with reduced noise for use, for example, in a fan or other fluid pumping structure, is disclosed. The structure includes a housing, a hub rotatably coupled to the housing, a plurality of blades, each with an inner edge attached to the hub, and a plurality of end-pieces. Each end-piece is attached to an outer edge of a corresponding one of the blades. Each end-piece extends in the axial direction beyond the surface of the outer edge of the corresponding blade. The advantage is that less turbulence is created by the blades, resulting in reduced noise and greater efficiency.

9 Claims, 6 Drawing Sheets

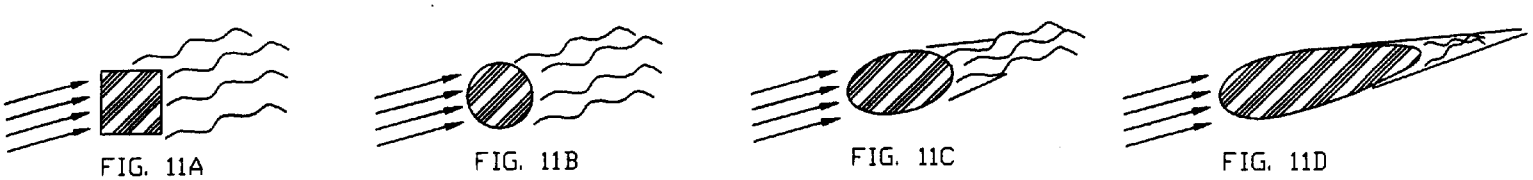
TURBULENCE DUE TO STRUT SHAPE
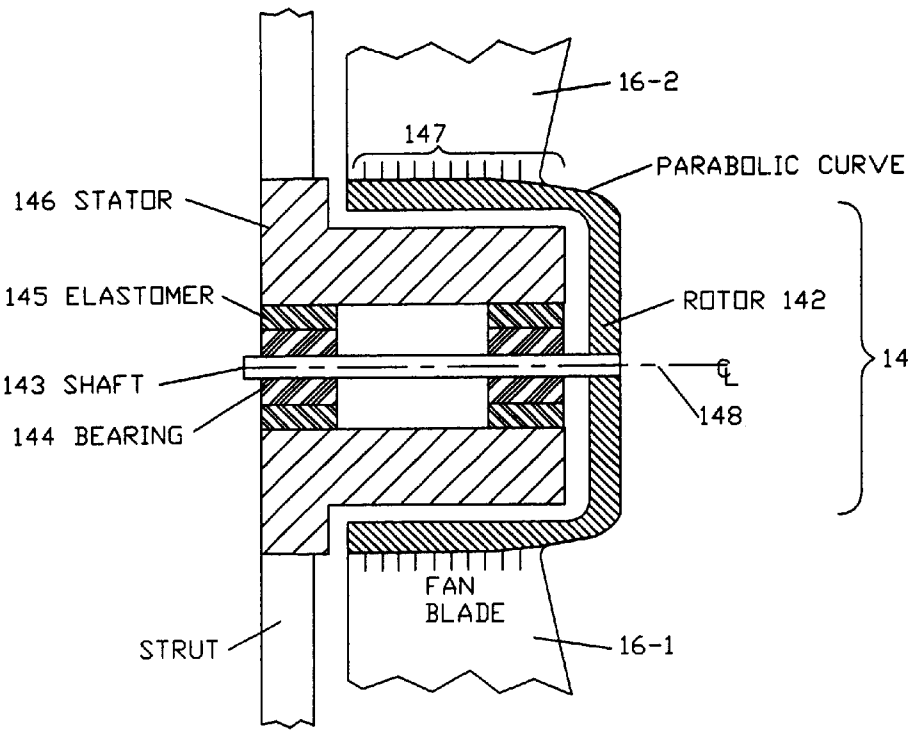
BEARING MOUNTING FIG. 10

FAN WITH REDUCED NOISE

TECHNICAL FIELD OF THE INVENTION

The present invention relates to equipment capable of pumping gases or liquids, such as rotary axial fans, propellers, axial compressors, turbines and similar structures and in particular to a fan with reduced noise.

BACKGROUND OF THE INVENTION

Cooling fans are ubiquitously used to provide forced air cooling of electronic equipment and other sources of heat such as heaters, air conditioners, heat exchangers and automobile engines. When cooling fans are used in a relatively quiet ambient noise environment, such as an office, fan noise is a significant problem. Personal computer cooling fans, for example, may create a majority of the ambient noise in a quiet office environment. This noise may annoy those working in that environment. Thus, the reduction of fan noise may significantly reduce the level of annoying noise experienced by those in a relatively quiet environment. Even in higher ambient noise environments, such as the vicinity of an automobile engine in operation, fan noise may contribute an appreciable amount to the noise level, making the reduction of fan noise a priority.

Fan noise originates from three related types of phenomena: aerodynamic, electromagnetic and mechanical. Aerodynamic phenomena causing fan noise include the blade end vortex, blade wake turbulence, hub turbulence, blade rate tone (siren effect), strut turbulence and hub/blade transition turbulence. Electromagnetic phenomena include magnetic field changes due to commutation, irregularity of the rotor gap and rotor and stator slots. Mechanical phenomena contributing to fan noise include bearing vibration and imbalance, both static and dynamic.

SUMMARY OF THE INVENTION

Of the various sources of fan noise previously mentioned, the dominant source is typically the fan blade end vortex, which also reduces the efficiency of the fan. Reduction of the blade end vortex is therefore obviously desirable because it reduces fan noise while increasing fan efficiency.

Therefore, a need has arisen for a fan that addresses the disadvantages and deficiencies of the prior art. In particular, a need has arisen for a fan which produces less noise.

Accordingly, in one aspect of the present invention, a fluid propulsion assembly includes a hub and a plurality of blades. Each blade has an inner edge attached to the hub. A plurality of end-pieces are each attached to an outer edge of a corresponding one of the blades. Each end-piece extends in the axial direction beyond the surface of the outer edge of the corresponding blade. In one embodiment, each end-piece extends in the axial direction by an amount sufficient to substantially prevent the formation a blade end vortex by its corresponding blade. In another embodiment, each end-piece extends upstream and downstream of the corresponding blade by an amount equal to at least three times the profile thickness of the corresponding blade.

In another aspect of the present invention, a fan includes a housing, a hub rotatably coupled to the housing, a plurality of fan blades, each with an inner edge attached to the hub, and a plurality of end-pieces. Each end-piece is attached to an outer edge of a corresponding one of the fan blades. Each end-piece extends in the axial direction beyond the surface of the outer edge of the corresponding fan blade.

An advantage of the present invention is that less turbulence is created by the fan blades, resulting in reduced fan noise and greater fan efficiency.

BRIEF DESCRIPTION OF THE DRAWINGS

For a more complete understanding of the present invention and for further features and advantages, reference is now made to the following description taken in conjunction with the accompanying drawings, in which:

FIG. 10 shows the stator portion of a fan together with the rotor to which the fan blades are attached and the shaft about which the fan blades rotate.

FIGS. 11*a* through 11*d* show in cross-section several possible shapes for the struts which hold the stationary portion (including the stator, the motor and the bearings) of the hub surrounding the rotatable shaft, in place in the fan.

DETAILED DESCRIPTION OF THE INVENTION

The preferred embodiments of the present invention and their advantages are best understood by referring to FIGS. 1 through 13 of the drawings. Like numerals are used for like and corresponding parts of the various drawings.

Figure 1:
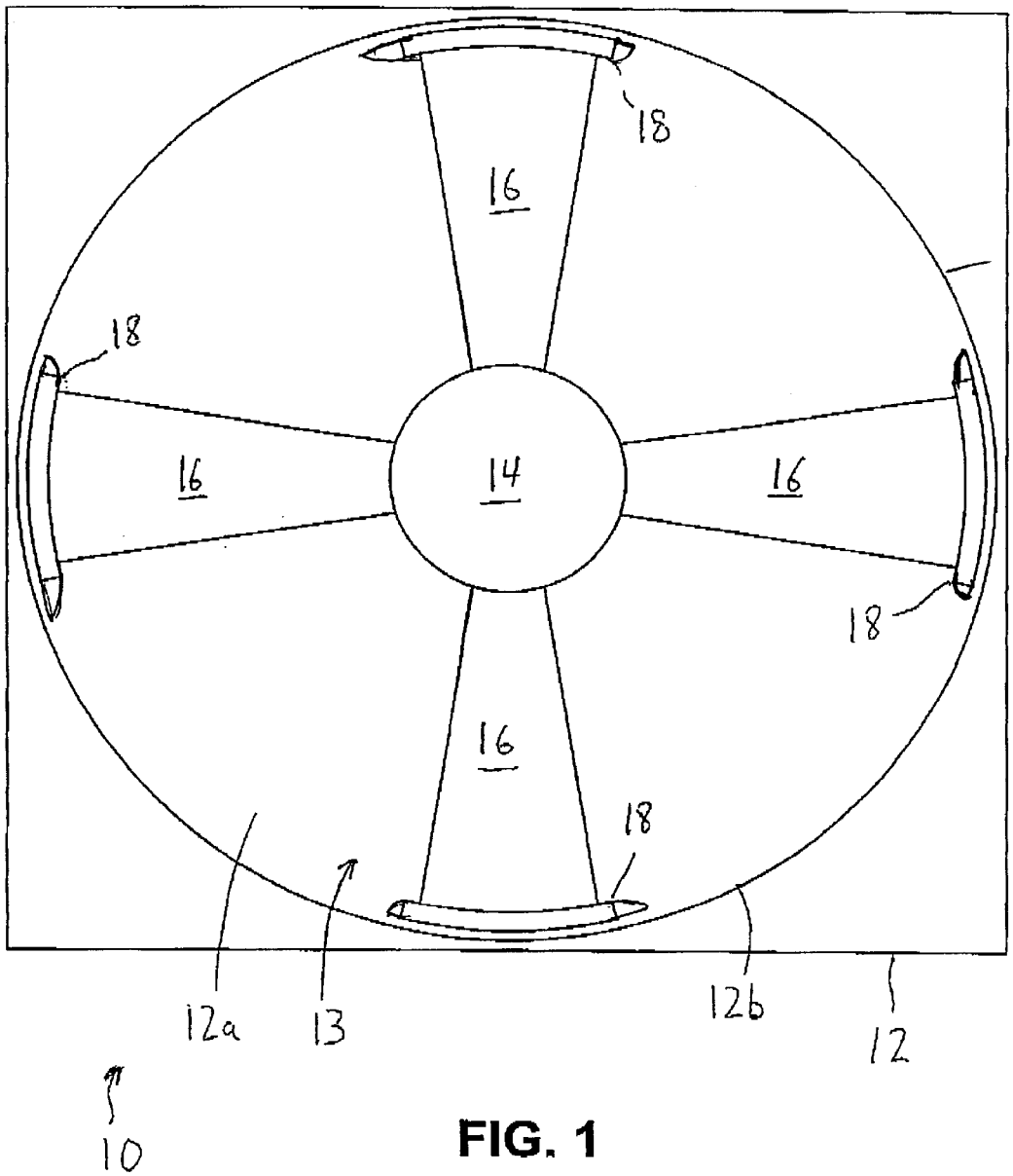
FIG. 1 is a front view of a fan designed in accordance with the present invention.

Referring to FIG. 1, a front view of a fan 10 designed in accordance with the present invention is shown. Fan 10 includes a housing 12 with a cylindrical aperture 12*a* defined by an interior wall 12*b*. A fan blade assembly 13 is mounted inside aperture 12*a*. Fan blade assembly includes a hub 14 and attached fan blades 16. Hub 14 is mounted on an axle (not shown) which is driven by a motor (not shown) in a conventional manner, the end result being that hub 14 is rotatably coupled (directly or indirectly) to housing 12.

Each fan blade 16 includes an end-piece 18 at its tip. The end-piece 18 of each fan blade 16 extends axially in both directions from the fan blade 16, thereby blocking the blade-end vortex which would normally be created by the pressure differential between front and back of the rotating fan blades 16. End-pieces 18 therefore increase the efficiency of fan 10 and decrease the noise generated by fan 10.

End-pieces 18 could be extended circumferentially and joined together in a continuous cylindrical outer ring attached to all of the fan blades 16. This arrangement has drawbacks, however. For example, it increases the inertia of the fan, which combined with low starting torque of a typical fan motor makes fan start very difficult. In addition, such a cylindrical outer ring has long spans between the tips of fan blades 16. These spans are unsupported in the radial direction, and are likely to bow outward under the centrifugal force generated by the rotation of fan 10. This could result in contact between fan blade assembly 13 and housing 12, which is undesirable for obvious reasons.

Furthermore, the shape of fan blades 16 attached to an outer ring would be problematic to manufacture as a single piece using injection molding. The plastic injected in a ring-shaped mold cavity would contract as it cools, decreasing the diameter of the resulting ring and pressing against the inner circumference of the ring-shaped mold cavity. Considerable friction would result upon ejection of the fan blade assembly from the mold cavity. This would cause significant wear on the mold, requiring frequent mold replacements and increasing production costs. Deformities in the fan blade assembly may also result. The design shown in FIG. 1 avoids these difficulties and uses less material than a ring-shaped design, while providing less inertia and most or all of the noise reduction benefit of the ring-shaped design.

A working example of this invention utilizes the motor, fan and housing of a MUFFIN XL AC fan (model no. MX2A1) available from Comair Rotron in San Diego, Calif. The tips of the fan blades were shaved to accommodate end-pieces 18, which consist of arcuate sheets of polypropylene with a thickness of three millimeters. This working example will be described more fully below.

Figure 2:
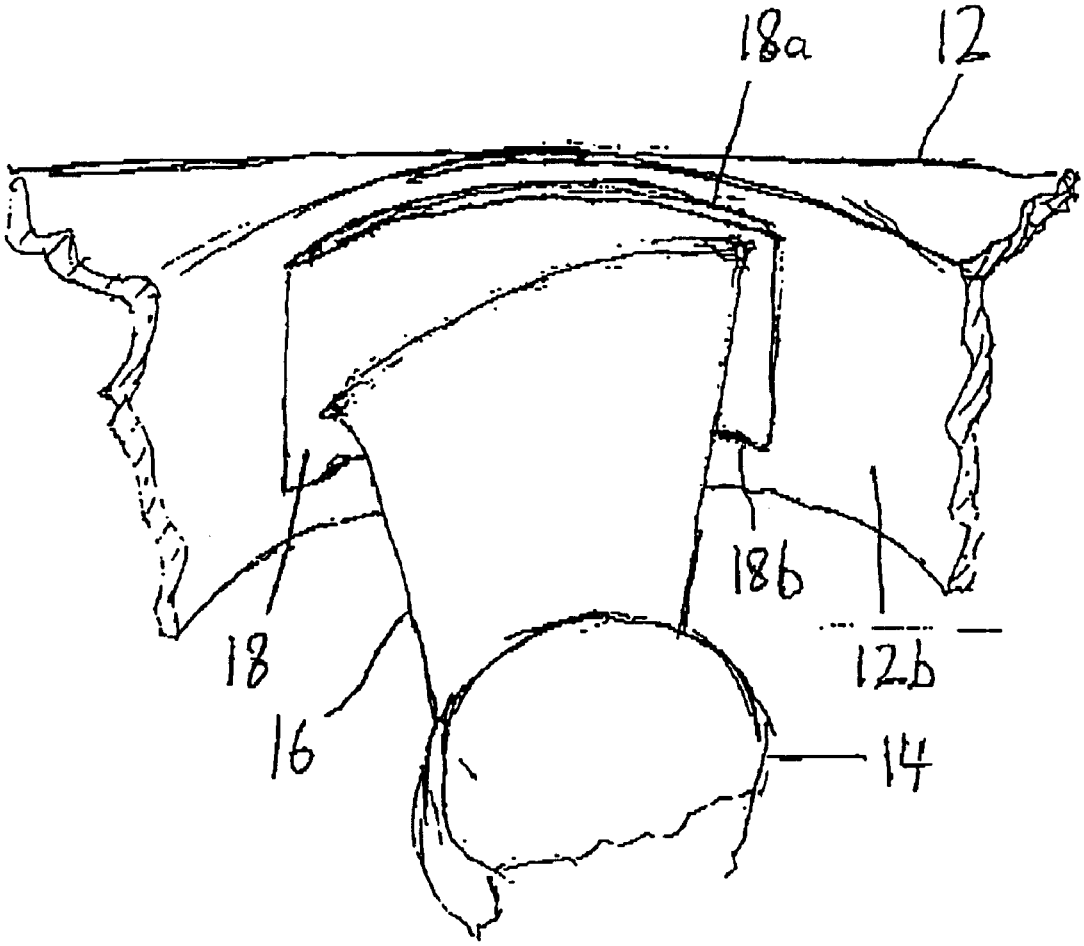
FIG. 2 is a perspective view of a cutaway portion of the fan.

Referring to FIG. 2, a perspective view of a cutaway portion of fan 10 is shown. Although many shapes are possible for end-piece 18, in this example end-piece 18 is an arcuate cylinder segment which matches the shape of the interior wall 12*b* of housing 12. End-piece 18 is therefore separated from interior wall 12*b* by a small, uniform gap over its entire surface.

As can be seen in FIG. 2, fan blade 16 is angled so as to force air movement in an axial direction when hub 14 rotates. Fan blade 16 also has an airfoil shape to force air flow in an axial direction. In this example, the front edge 18*a* and back edge 18*b* of end-piece 18 are perpendicular to the axis of fan 10 and to the primary direction of air flow.

Figure 3:
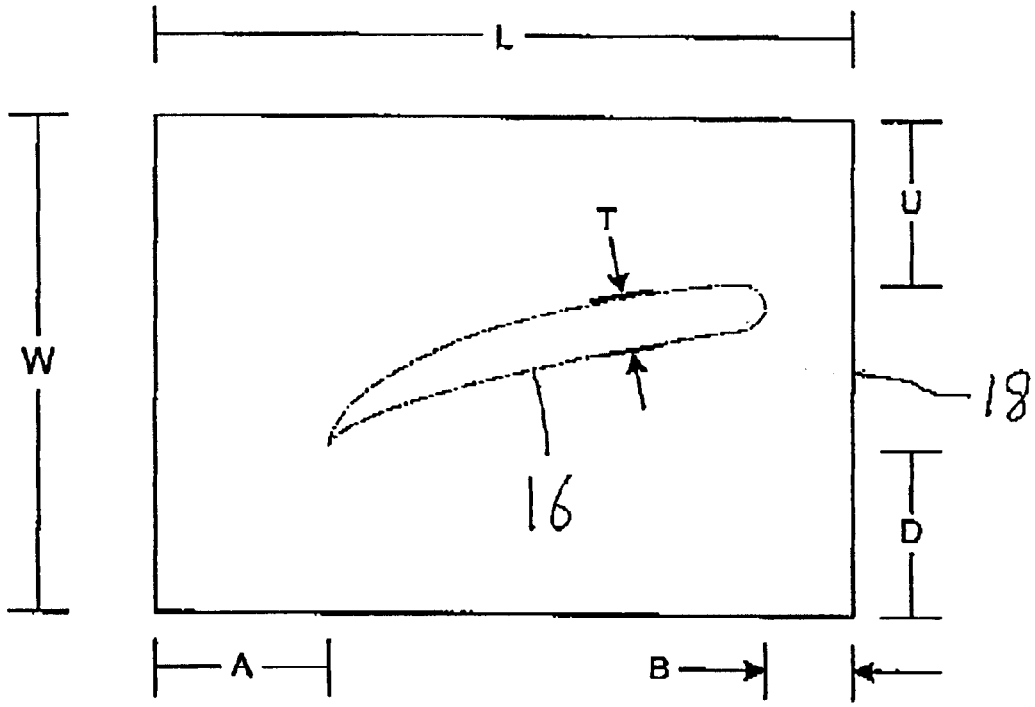
FIG. 3 is an end view of a fan blade.

Referring to FIG. 3, an end view of a fan blade 16 is shown, looking radially inward at the outer surface of end-piece 18 and the tip of fan blade 16. In this figure, the dimensions of end-piece 18 have been exaggerated for purposes of illustration. As shown in FIG. 3, fan blade 16 has a profile thickness T. End-piece 18 has an axial dimension or width W and a chord length L.

As previously mentioned, each end-piece 18 extends in an axial direction both upstream and downstream of its fan blade 16. In this context, "upstream" refers to the axial direction from which air enters fan 10 ("up" in FIG. 3), while "downstream" refers to the axial direction in which air is forced by fan 10 ("down" in FIG. 3). End-piece 18 extends in the upstream direction by an amount U beyond the upstream tip of fan blade 16. Similarly, end-piece 18 extends in the downstream direction by an amount D beyond the downstream tip of fan blade 16. End-piece 18 also extends beyond the trailing edge of fan blade 16 by an amount A, and extends in the direction of rotation beyond the leading edge of fan blade 16 by an amount B.

Table 1 presents the various dimensions pertaining to the aforementioned working example of fan 10.

TABLE 1

| Dimension symbol | Dimension (mm) |
|---|---|
| L | 50 |
| W | 30 |
| U | 4 |

TABLE 1-continued

| Dimension symbol | Dimension (mm) |
|---|---|
| D | 1 |
| A | 7 |
| B | 3 |

Figure 4:
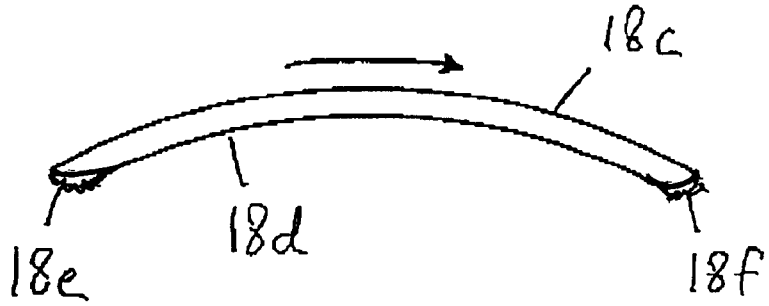
FIG. 4 is a side view of a fan blade end-piece.
Figure 5:
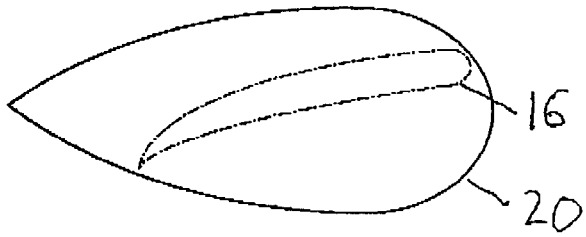
FIG. 5 is an inward radial view of an end-piece and fan blade.

Referring to FIG. 4, a side view (in the axial direction) of an end-piece 18 is shown. The direction of rotation of fan 10 is indicated in FIG. 4 with an arrow. End-piece 18 has an outer surface 18*c*, an inner surface 18*d*, a trailing edge 18*e* and a leading edge 18*f*. To improve the aerodynamic characteristics of end-piece 18, leading edge 18*f* and trailing edge 18*e* are rounded. The radius of curvature of each surface in the working example is given in Table 2.

TABLE 2

| Surface | Radius (mm) |
|---|---|
| 18c | 55 |
| 18d | 52 |
| 18e | 10 |
| 18f | 5 |

Various aspects of this working example may be modified to improve the operating characteristics or production costs of fan 10. For example, referring to FIG. 3, the width (W) of end-piece 18 may be chosen so as to effectively block the blade-end vortex created by fan blade 16 without unduly increasing the axial dimension of fan 10. For this purpose, the upstream extension (U) and downstream extension (D) may deviate from recommended three to four times the profile thickness (T) of fan blade 16.

Also, as previously mentioned, a fan blade assembly consisting of a hub, fan blades and end-pieces may be manufactured from several plastic compounds using conventional molding processes. As discussed above, the design described herein is more suitable for injection mold production than a fan blade assembly with a complete outer ring.

Another improvement which may be made is to give the end-pieces a more aerodynamic shape. For example, in FIG. 5, an inward radial view of an end-piece 20 and fan blade 16 is shown. End-piece 20 has a teardrop-shaped outline, which creates less turbulence than the substantially rectangular shape previously described. In order to substantially block the blade-end vortex created by fan blade 16, end-piece may, at its furthest points, extend upstream and downstream from fan blade 16 by an amount equal to three to four times the profile thickness of fan blade 16. This ratio seems to be a good compromise between size and efficiency.

Figure 6:
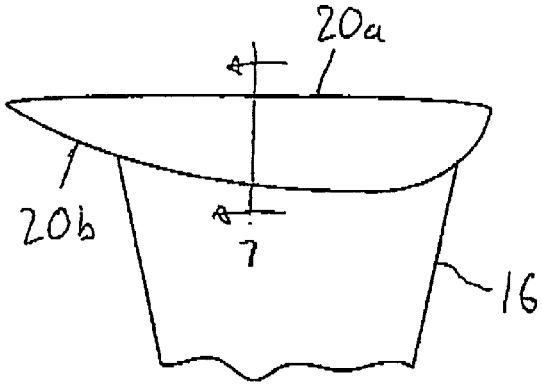
FIG. 6 is a side view of another end-piece.
Figure 7:
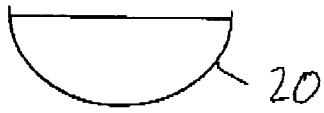
FIG. 7 is a cross section of the end-piece.

In side view, end-piece 20 may have a half-teardrop shape as shown in FIG. 6. In this example, outer surface 20*a* is curved slightly to conform to the inner surface of the fan housing, while inner surface 20*b* has a teardrop shape. In this case, end-piece 20 has a half-elliptical cross section as shown in FIG. 7.

Figure 8:
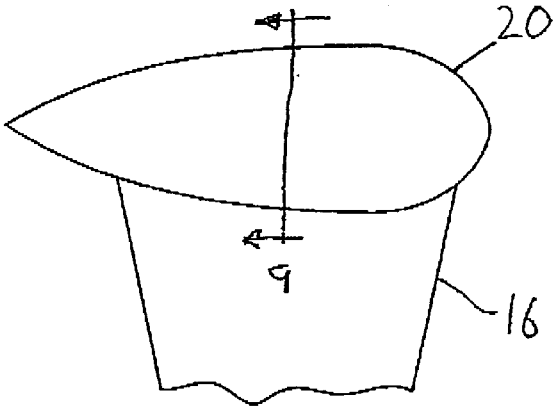
FIG. 8 is a side view of another end-piece.
Figure 9:
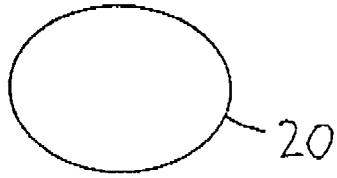
FIG. 9 is a cross section of the end-piece.

Alternatively, end-piece 20 a free standing fan (fan without housing) may have a full teardrop shape (in side view) as shown in FIG. 8. In this case, end-piece 20 has an elliptical cross section as shown in FIG. 9. Either one of these shapes improves the air flow over end-piece 20, producing less turbulence and greater fan efficiency. As yet another alternative, end-piece 20 may be given an airfoil shape so as to impel air radially inward.

FIG. 10 shows hub 14 in cross-section with two fan blades 16-1 and 16-2 extending from the hub. Naturally, additional fan blades not shown can also extend from the hub. Fan blades 16-1 and 16-2 are shown mounted on rotor 142 with a fairing formed at the junction of each plate 16 with rotor 142. Fairing 147 can have a radius of curvature determined by experiment. Typical radii of curvature would vary depending on the size of the blade 16 and the rotor 142. For a typical house fan the radius of curvature would be appropriately 1/16 of an inch although this radius can vary depending on the design and size of the fan.

Rotor 142 is mounted on and fixedly attached to shaft 143 which in turn is held in place along the axis 148 of the fan (denoted also as a center line by the notation CL). Centerline CL defines the axial direction of the fan. Shaft 143 rotates in bearings 144. Typically shaft 143 will pick up vibrations from rotor 142 and blades 16 during operation of the fan and will transmit these vibrations to the stator 146. In accordance with this invention, an elastomer 145 is placed between the bearings 144 and the stator 146 to substantially if not totally dampen these vibrations and thereby prevent the transmission of the noise generated by these vibrations to the structure holding the fan. This reduces the noise generated by the fan. Elastomer 145 can be any vibration damping material, but typically is a polyurethane with a high internal damping coefficient.

The hub 14 typically has a curved surface 141 to further reduce the turbulence resulting from the flow of air or other fluid past the hub. Curved surface 141 may typically be parabolic, but again the actual shape of the surface to minimize the turbulence will depend upon the size of the hub 141 and the other characteristics of the fan such as the rotateonal speed of the blades, the length of the blades and the diameter of the hub in relation to the diameter of the blades.

Struts are used to hold the stator 146, the elastomer 145 and the bearings 144 in fixed position in the flow path of the gas or fluid being moved by the fan. Typical struts have a square or rectangular cross-section as shown in FIG. 11A. Such a cross-section creates turbulence in the air flow. The circular cross-section of FIG. 11B reduces the turbulence of the air flow substantially while the ellipsoidal cross-section of the strut aligned with the fluid flow shown in FIG. 11C further reduces the resulting turbulence of the air flow. A teardrop-shaped cross-section aligned with the fluid flow for the strut as shown in FIG. 11D results in even a further reduction in the turbulence associated with the air flow through the fan. Reduction of the turbulence reduces the energy wasted in pumping the air and also decreases the noise generated by the pumping of the air.

Figure 13A:
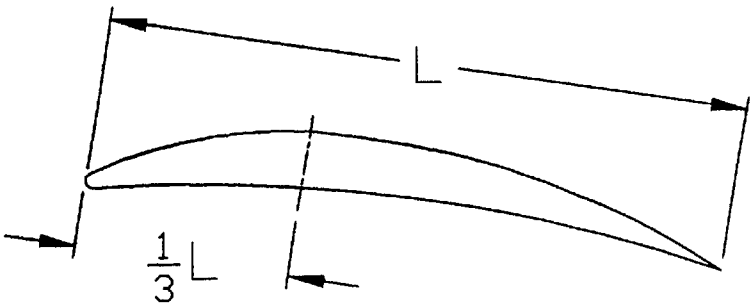
FIGS. 12, 13*a* and 13*b* show the cross-sections of a prior art blade and a super-critical blade of the type used with this invention, respectively.
Figure 13B:
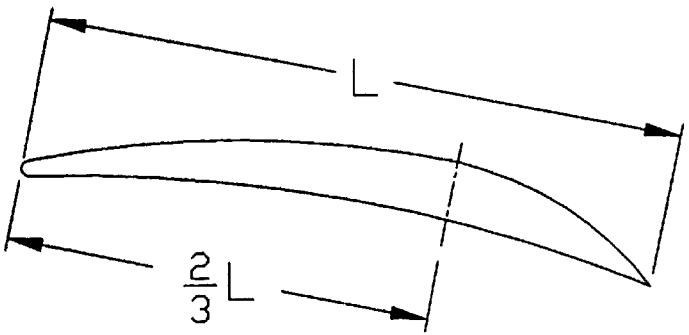
Figure 12:
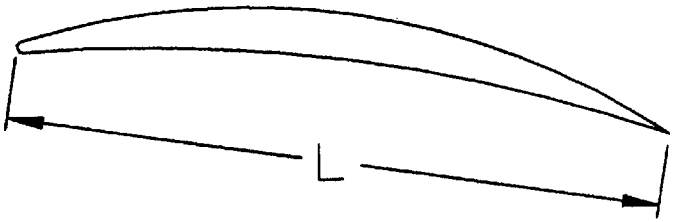

Finally, the cross-section of the blade 16 is of importance in determining the efficiency of the fan and the noise generated by the fan. Typically, the cross-section of the fan blade is as shown in FIG. 12. In FIG. 12, a top surface 120 is formed from a material having a curve with a first radius of curvature while the bottom surface 121 is formed to have a curve with a second radius of curvature, the second radius of curvature being larger than the first radius of curvature. This cross-section is one typical cross-section for a fan blade. As shown however, in FIG. 13*b*, in accordance with this invention, a super-critical cross-section is employed resulting in much less turbulence associated with the fan blade. As shown in FIG. 12, the cross-section of the fan blade has a length L known as the cord. The thickest section of the cross-section shown in FIG. 13*a* is approximately one-third L, that is one-third of the cord length, from the front F of the fan blade. In FIG. 13*b*, the thickest portion of the air flow is approximately two-thirds L from the front F of the fan blade. The fan blade cross-section shown in FIG. 13*b* results in the location of the separation of the air flowing pass the blade (i.e. the beginning of turbulent flow) moving further back along the blade thereby reducing the total turbulence associated with the motion of the blade through the air or other gas or fluid being pumped. The cross-section of the blade in FIG. 13*b* is such that any super-critical shape of a type well-known in the aeronautics industry can be used for the fan blade. Thus, the cross-section of the super-critical blade used in a fan in accordance with this invention will not be described in any further detail.

While the words "air" and "fan" have been used throughout the foregoing description, it will be understood that the designs described herein may be used to reduce noise and increase efficiency in other fluid propulsion systems involving blades or propellers, such as turbines, compressors, and the like, as well as fans.

Although the present invention and its advantages have been described in detail, it should be understood that various changes, substitutions, and alterations can be made therein without departing from the spirit and scope of the invention as defined by the appended claims.

I claim:

1. A fan comprising:

a housing;

a hub rotatable coupled to the housing;

a plurality of fan blades, each fan blade having an inner edge attached to the hub; and a plurality of end-pieces, each end-piece being attached to an outer edge of a corresponding one of the fan blades, each end-piece extending in an axial direction beyond a surface of the outer edge of the corresponding fan blade, wherein each fan blade having an inner edge attached to the hub, is attached to the hub by material, including a fairing between the surface of the blade and the hub.

2. A fan comprising:

a housing;

a hub rotatably coupled to the housing;

a plurality of fan blades, each fan blade having an inner edge attached to the hub; and a plurality of end-pieces, each end-piece being attached to an outer edge of a corresponding one of the fan blades, each end-piece extending in an axial direction beyond a surface of the outer edge of the corresponding fan blade, wherein each end-piece extends in the axial direction by an amount sufficient to substantially prevent the formation of a blade end vortex by the corresponding fan blade, wherein the fairing has a radius of curvature of approximately 1/16 of an inch.

3. A fan comprising:

a housing;

a hub rotatably coupled to the housing;

a plurality of fan blades, each fan blade having an inner edge attached to the hub; and a plurality of end-pieces, each end-piece being attached to an outer edge of a corresponding one of the fan blades, each end-piece extending in an axial direction beyond a surface of the outer edge of the corresponding fan blade, wherein each end-piece extends upstream and downstream of the corresponding fan blade by an amount equal to at least three times a profile thickness of the corresponding fan blade.

4. A fan comprising:

a housing;

a hub rotatably coupled to the housing;

a plurality of fan blades, each fan blade having an inner edge attached to the hub; and a plurality of end-pieces, each end-piece being attached to an outer edge of a corresponding one of the fan blades, each end-piece extending in an axial direction beyond a surface of the outer edge of the corresponding fan blade, wherein each end-piece comprises an airfoil operable to impel a fluid medium radially inward when the fan blades are rotated relative to the fluid medium.

5. A fan comprising:

a housing;

a hub rotatably coupled to the housing;

a plurality of fan blades, each fan blade having an inner edge attached to the hub; and a plurality of end-pieces, each end-piece being attached to an outer edge of a corresponding one of the fan blades, each end-piece extending in an axial direction beyond a surface of the outer edge of the corresponding fan blade, including:

a stator to rotatably support said hub;

a shaft rotatably mounted in said stator, said shaft being fixedly attached to said hub, such that when said hub rotates said shaft also rotates;

at least two struts holding said stator in place relative to said housing;

bearings contained in said stator supporting said shaft; and an elastomer placed between said bearings and said stator for absorbing vibrations generated in said hub and/or blades.

6. The fan of claim 5, wherein each of said struts has a cross-section shaped to reduce turbulence relative to the turbulence associated with a rectangular cross-section.

7. The fan of claim 6, wherein the cross-section of each strut is tear shaped so as to reduce the turbulence generated during the motion of the fluid being moved by the fan past the struts.

8. A fan comprising:

a housing;

a hub rotatably coupled to the housing;

a plurality of fan blades, each fan blade having an inner edge attached to the hub; and a plurality of end-pieces, each end-piece being attached to an outer edge of a corresponding one of the fan blades, each end-piece extending in an axial direction beyond a surface of the outer edge of the corresponding fan blade, wherein said hub has a curved surface, the center of said curved surface being centered on a center line of the fan, the surface having a shape such as to reduce the turbulence associated with the fluid moving past the hub.

9. The fan of claim 8, wherein the curved surface is a parabolic surface.

* * * * *